United States Patent [19]

Kirsch et al.

[11] Patent Number: 4,493,245

[45] Date of Patent: Jan. 15, 1985

[54] ROTARY AND LINEAR ACTUATING DEVICE

[75] Inventors: Jerry Kirsch, Grosse Pointe Farms; Kerry F. Kirsch, Livonia; Kenneth J. Hornacek, Pontiac, all of Mich.

[73] Assignee: Rimrock Corporation, Columbus, Ohio

[21] Appl. No.: 487,573

[22] Filed: Apr. 22, 1983

[51] Int. Cl.[3] ..... F01B 21/00; F01B 29/00; F15B 15/24

[52] U.S. Cl. ..... 92/2; 92/13.7; 92/85 A; 92/121; 92/128; 91/61

[58] Field of Search ..... 92/2, 116, 121, 13, 92/13.5, 13.7, 68, 85 A, 128; 91/61; 308/3 A, 3 R, 6 R

[56] References Cited

U.S. PATENT DOCUMENTS

| | | | |
|---|---|---|---|
| 2,262,432 | 11/1941 | Rodder et al. | 92/85 A |
| 2,338,093 | 1/1944 | Caldwell | 308/3 R |
| 2,437,213 | 3/1948 | Slomer | 92/2 |
| 2,893,210 | 7/1959 | Muszynski | 92/65 |
| 4,186,651 | 2/1980 | Taig | 92/121 |
| 4,186,911 | 2/1980 | Huet et al. | 92/2 |
| 4,254,639 | 3/1981 | Teramachi | 308/6 R |

OTHER PUBLICATIONS

H. E. Thompson, "Spline Joint", Apr. 1960, IBM Technical Disclosure Bulletin, vol. 2, No. 6, pp. 7–8.

*Primary Examiner*—Robert E. Garrett
*Assistant Examiner*—H. Edward Li
*Attorney, Agent, or Firm*—Harness, Dickey & Pierce

[57] ABSTRACT

A rotary and linear actuating device is disclosed for imparting precision rotary and linear movement to an external member or assembly. In a preferred form of the invention a rotatable assembly is rotated about an axis within a housing by selectively varying the relative pressures of an actuating fluid in at least a pair of fluid pressure chambers defined by the housing, the rotatable assembly and at least a pair of vane members extending therebetween. An elongated shaft member is rotationally fixed relative to the rotatable assembly and is supported by at least a pair of linear bearing assemblies to allow linear movement of the elongated shaft member along said axis. The linear bearing assemblies remain a fixed axial distance from one another in order to adequately support heavy loads on the elongated shaft member and the external member or assembly attached thereto. The device also preferably includes adjustment means for selectively adjusting the clearance between the elongated shaft member and the linear bearing assemblies.

8 Claims, 6 Drawing Figures

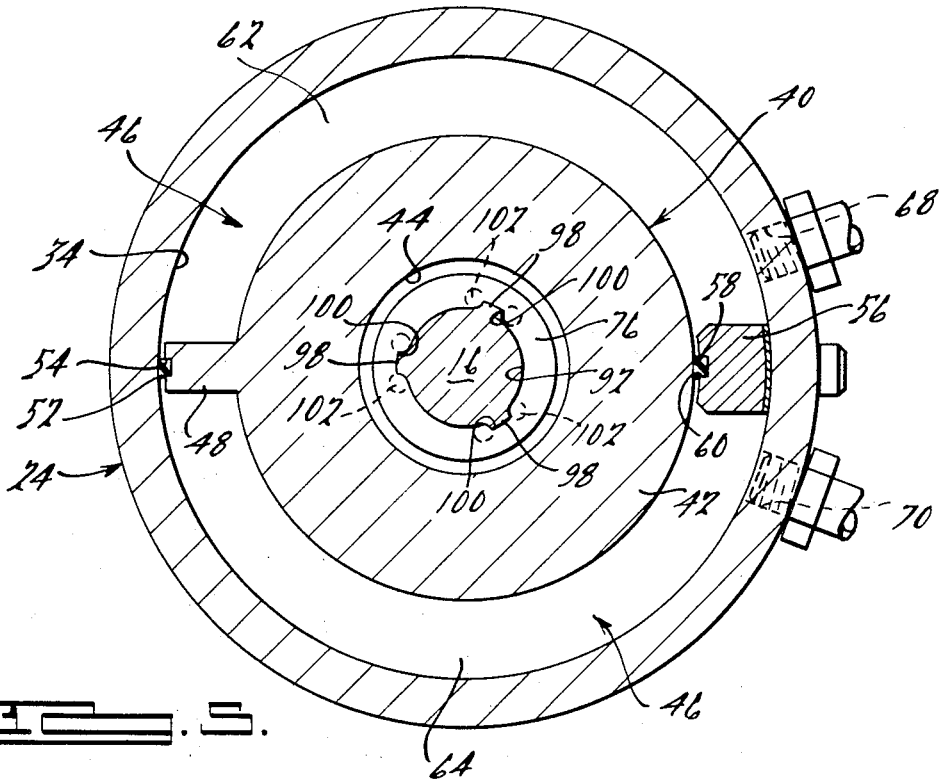
FIG. 5.
FIG. 6.
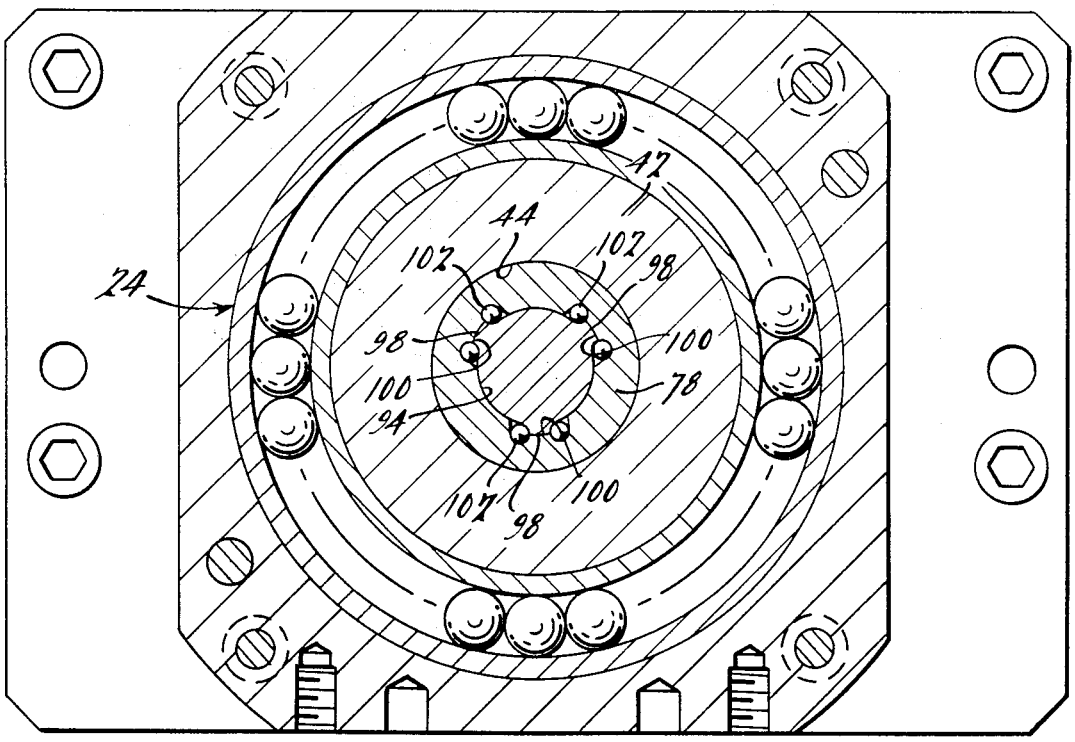

ROTARY AND LINEAR ACTUATING DEVICE

BACKGROUND AND SUMMARY OF THE INVENTION

The invention relates generally to actuating devices, and more specifically to such devices having an axially-extending elongated actuating shaft that is rotatable about an axis and linearly movable along said axis in order to impart rotary and linear movement to another member or assembly.

Various rotary and linear actuating devices have been provided for imparting both rotary and linear movement to an external member. Such devices frequently include a rod or other member rotatably driven by a rack and pinion gear assembly that transforms linear motion to rotary motion. The rack and pinion assembly is in turn actuated by a pneumatic or hydraulic cylinder. One end of such a rotatable rod member is typically interconnected with another pneumatic or hydraulic cylinder for linear movement along the rod member's axis of rotation. An example of such prior devices is disclosed in U.S. Pat. No. 4,186,911.

Frequently, however, such previous devices are not well-suited for automated applications in point-to-point robot devices requiring precise actuation and positioning of a movable arm assembly used to lift heavy parts and reposition them in a very precise location. Such prior devices often include linear bearing assemblies that do not adequately support a heavy load on the arm assembly for precision movement thereof when the rod member is fully extended. Additionally, such prior devices frequently have too much clearance or backlash between the rod member and the linear bearings to allow for the required precision placement of parts or other items being transferred by the arm assembly, and typically do not have means for adjusting the amount of said clearance to accommodate wear in the mechanism.

In accordance with the present invention, an actuating device includes a rotatable assembly disposed for rotation about an axis within a housing. At least a portion of the rotatable assembly and the housing are radially spaced apart to define a fluid chamber therein, with means for varying the fluid pressure within the fluid pressure chamber in order to selectively vary the rotary position of the rotatable assembly relative to the housing. The rotatable assembly also includes an elongated member extending coaxially therethrough and preferably adapted to be secured to an external member that is to be actuated by the actuating device. The elongated member is preferably movable linearly along the axis of rotation of the rotatable assembly but is restrained for rotation with the rotatable assembly.

In a preferred embodiment of the present invention, the rotatable assembly has at least one radially-extending vane or blade member secured for rotational movement therewith in slidable and sealing engagement with the inside wall of the housing. The housing includes at least one radially-extending fixed vane or blade member protruding therefrom to slidably and sealingly engage the rotatable assembly. The rotatable and fixed vane members separate the generally annular space between the rotatable assembly and the housing into at least a pair of fluid pressure chambers. Thus the relative pressures in the fluid pressure chambers may be selectively varied in order to vary the rotary position of the rotatable assembly and the elongated member.

In a preferred form of the invention, the rotatable assembly also preferably includes a rotatable sleeve member having a substantially coaxial opening extending therethrough. At least a pair of generally cylindrical linear bearing assemblies are received within opposite ends of the opening in the rotatable assembly and are connected for rotation therewith. The elongated member is preferably carried within the linear bearing assemblies by means of a ball spline connection such that the elongated member is rotationally restrained relative to the linear bearing assemblies and the rotatable assembly, but linearly movable along the rotational axis of the rotatable assembly. The generally cylindrical linear bearing assemblies may be slightly rotated in opposite directions before being secured for rotation with the rotatable assembly, thereby allowing the clearance in the linear bearing assembly to be adjusted.

Additional advantages and features of the present invention will become apparent from the following description and the appended claims, taken in conjunction with the acompanying drawings.

BRIEF DESCRIPTION OF THE DRAWINGS

FIG. 5 is a lateral cross-sectional view of the rotary and linear actuating device, taken along line 5—5 of FIG. 4.

FIG. 6 is still another lateral cross-sectional view of the rotary and linear actuating device, taken along line 6—6 of FIG. 4.

DETAILED DESCRIPTION OF THE PREFERRED EMBODIMENTS

Figure 1:
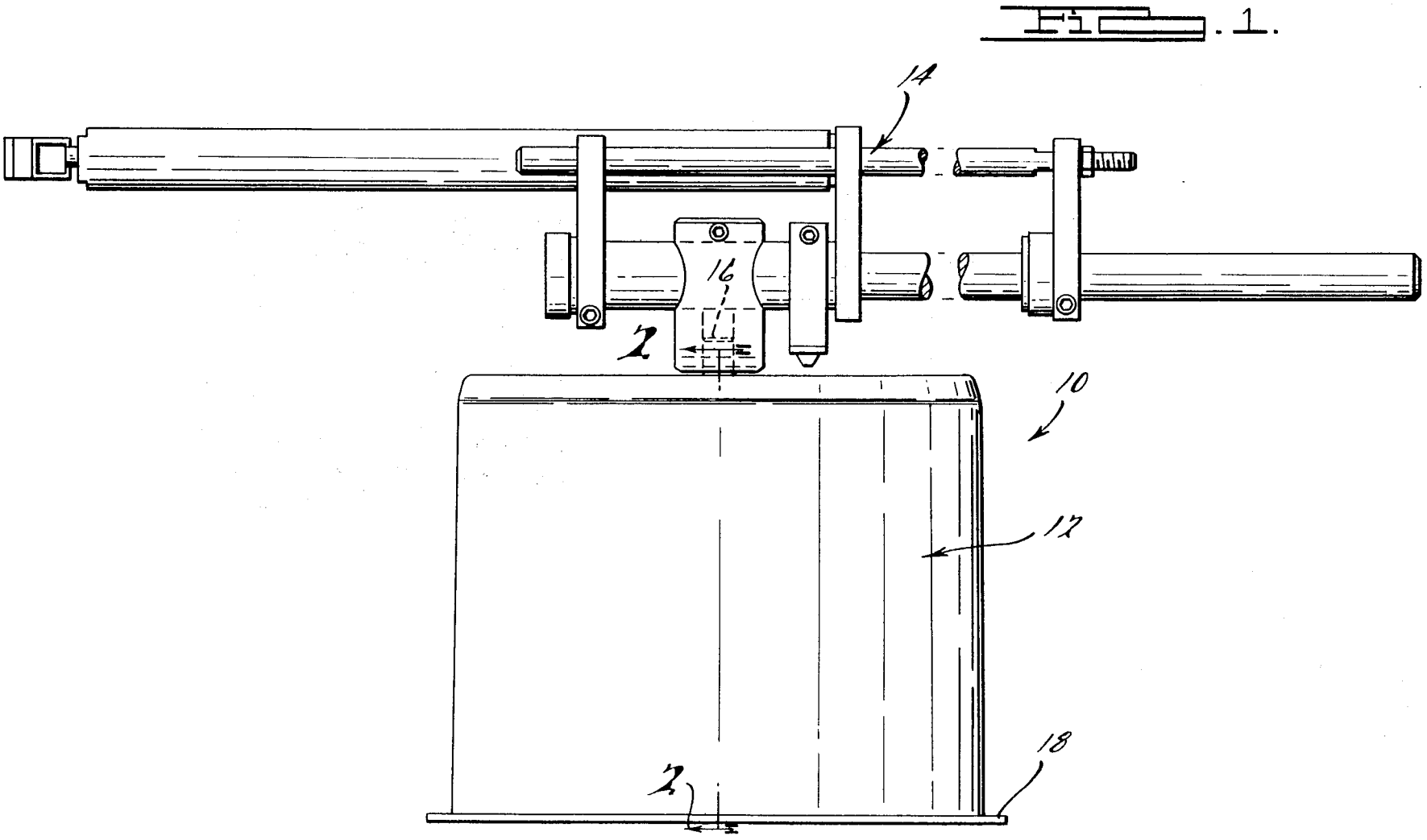
FIG. 1 is a side elevational view of a point-to-point transfer apparatus including a rotary and linear actuating device according to the present invention.

For purposes of illustrating the principles of the invention, FIGS. 1 through 6 of the drawings depict an exemplary embodiment of the rotary and linear actuating device, according to the present invention, as incorporated in an apparatus known as a point-to-point transfer robot, adapted for the precision lifting and transferring of parts or other items from one location to another. One skilled in the art will readily recognize from the following description that the principles of the present invention are equally applicable to rotary and linear actuating devices other than that shown for purposes of illustration in the drawings, as well as to rotary and linear actuating devices for other types of apparatus.

Figure 2:
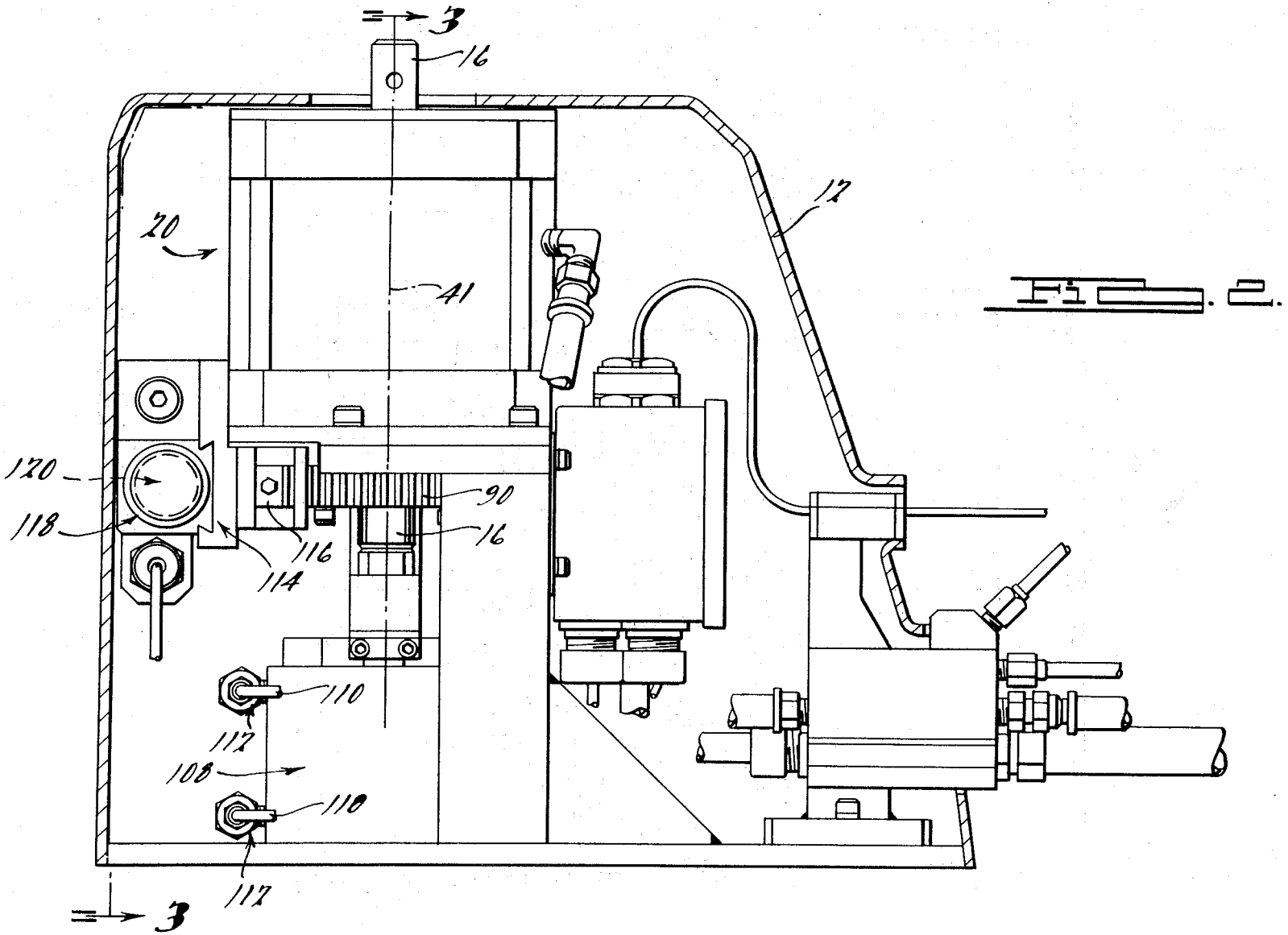
FIG. 2 is a partial cross-sectional view of the transfer apparatus of FIG. 1, taken along line 2—2 thereof.
Figure 3:
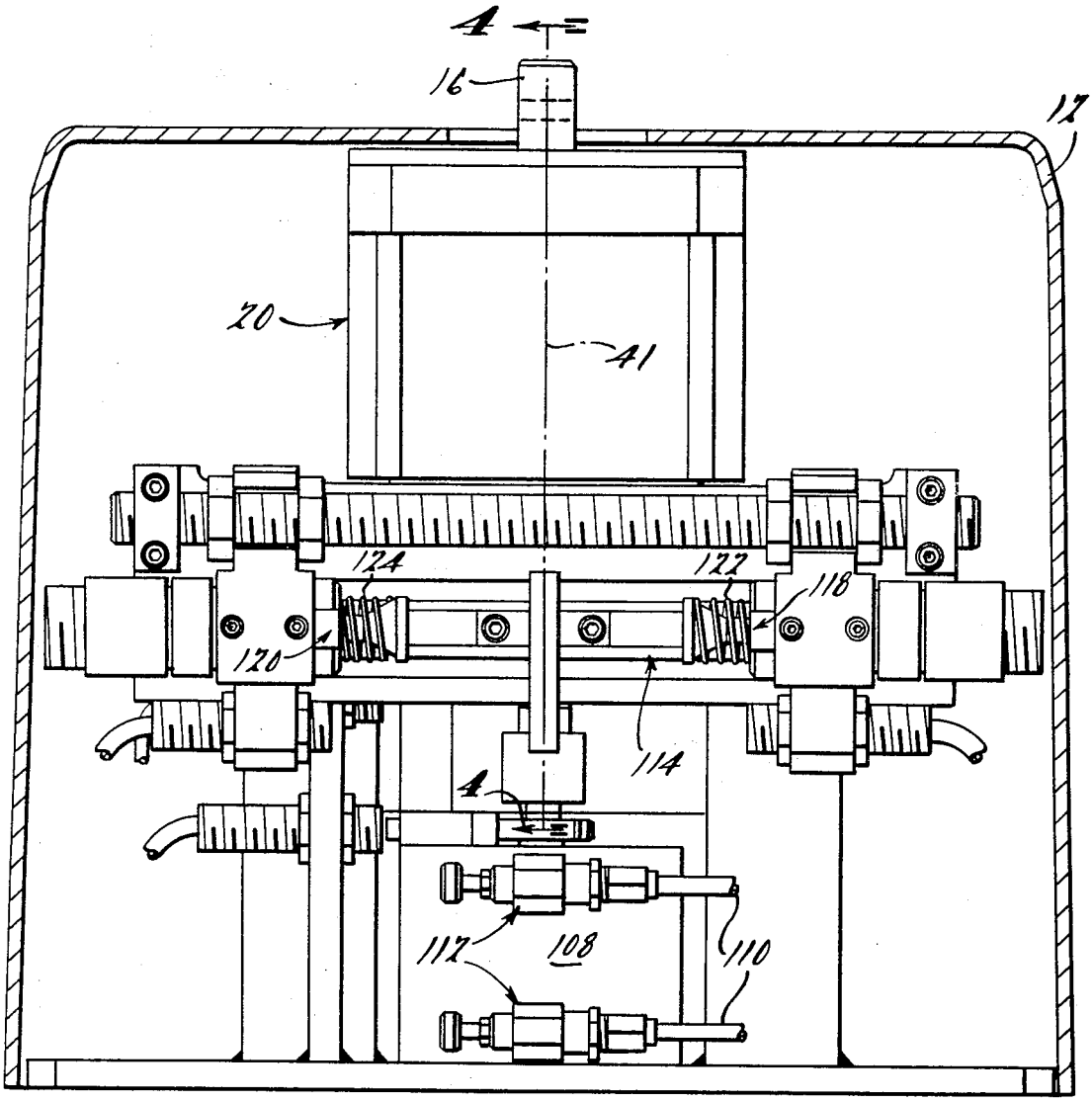
FIG. 3 is another partial cross-sectional view of the transfer apparatus of FIG. 1, taken along line 3—3 of FIG. 2.

In FIG. 1, a point-to-point transfer robot apparatus 10 generally includes a main body portion 12, which houses a rotary and linear actuating assembly according to the present invention, and a movable arm assembly 14. The arm assembly 14 may be of the type disclosed in U.S. Pat. Nos. 3,664,854 and 3,777,902, for example, the disclosures of which are incorporated by reference herein. The arm assembly 14 is connected for rotary and linear motion to the main body portion 12 by way of an elongated shaft member 16 protruding outwardly from the body portion 12. The body portion 12 is securely mounted on a base 18 or other generally immovable object. FIGS. 2 and 3 illustrate a rotary and linear actuating device 20 according to the present invention, which is enclosed within the main body portion 12 along with other associated apparatus described below.

Figure 4:
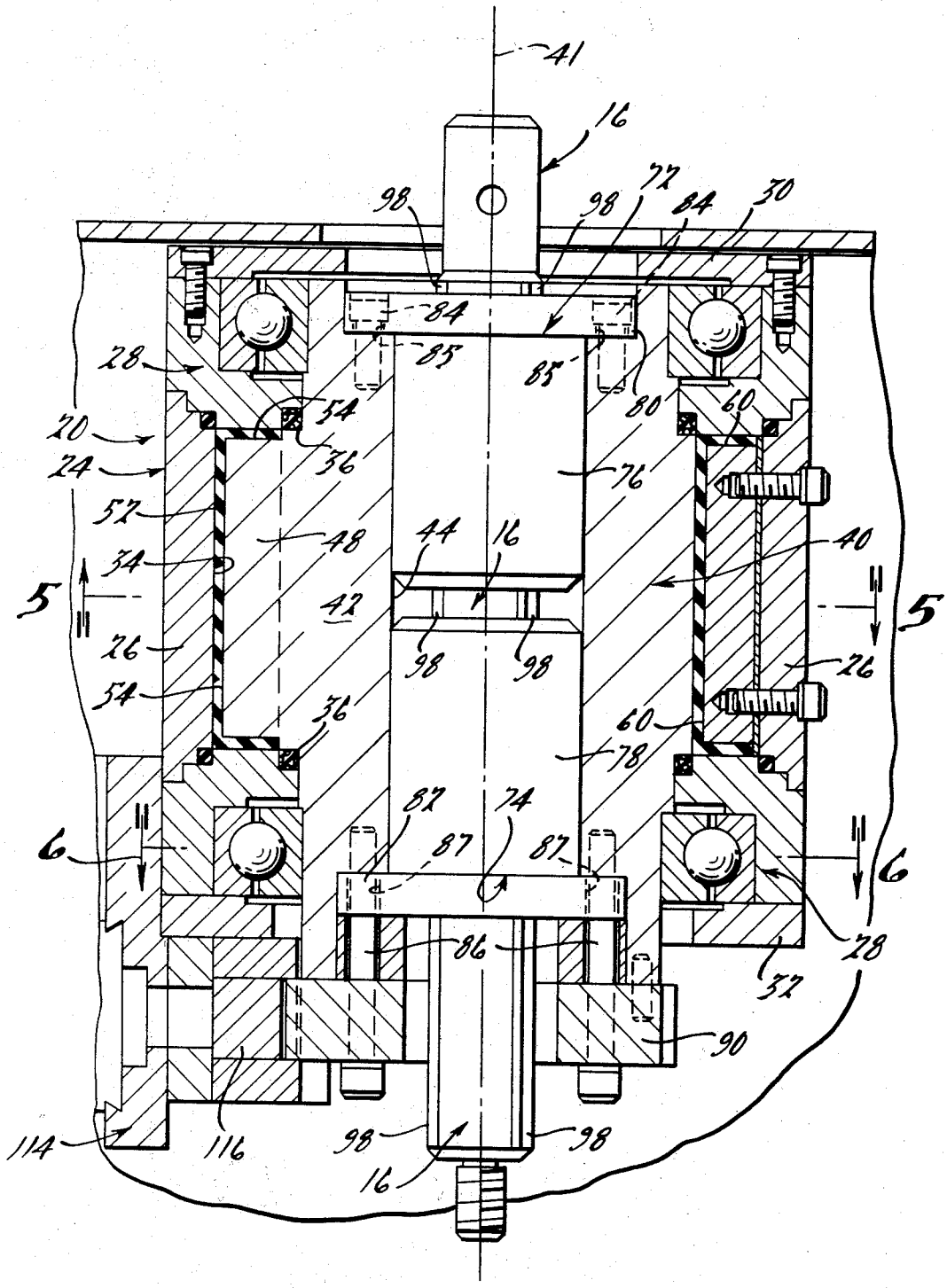
FIG. 4 is a longitudinal cross-sectional view of the rotary and linear actuating device shown in FIGS. 2 and 3, taken along line 4—4 of FIG. 3.

As illustrated in FIGS. 4 through 6, a housing assembly 24 for the rotary and linear actuating device 20 includes a fixed generally cylindrical outer sleeve portion 26, with rotary bearing assemblies 28 at each end, and is enclosed by an outer end plate 30 and an inner end plate 32. A rotatable assembly 40 is sealingly journaled within the housing assembly 24 for rotation about an axis 41, with annular seals 36 sealingly disposed between each end of the rotatable assembly and the associated end plates 32 and 34. The rotatable assembly 40 preferably includes a generally cylindrical rotatable sleeve member 42 having a coaxial opening 44 extending therethrough. At least a portion of the rotatable sleeve member 42 is radially spaced from the fixed outer sleeve portion 26 of the housing assembly 24, as shown in FIG. 5, to define a generally fluid-tight annular space 46 therebetween. The rotatable assembly 40 also includes at least one movable vane or blade member 48 protruding in a generally outward radial direction and secured to the sleeve member 42 for rotation therewith. The movable vane member 48 includes a sealing member 52, which is received within a groove 54 and which slidably and sealingly engages the inside wall 34 of the outer sleeve portion 26. Similarly, at least one fixed vane or blade member 56 is secured to the inside wall of the outer sleeve portion 26 and includes a sealing member 58 received in a groove 60 and slidably and sealingly engaging the rotatable sleeve member 42. The movable vane member 48 and the fixed vane member 56 separate the annular space 46 into at least a pair of fluid pressure chambers 62 and 64 illustrated in FIG. 5. The exact number of fixed and movable vane members, and thus the exact number of corresponding fluid pressure chambers depends upon the particular application and upon such factors as the number of discrete stopping points along the rotary path of the member or assembly that is to be rotatably actuated by the actuating device 20.

The fluid pressure chambers 62 and 64 are supplied with an actuating fluid through a corresponding number of fluid inlets, such as 68 and 70, respectively. The relative pressures of the actuating fluid in the chambers 62 and 64 may be selectively varied by way of control means well known to those skilled in the art in order to cause the rotatable sleeve member 42 and the movable vane member 48 to rotate about the axis 41 in order to selectively vary the rotary position of the rotatable assembly 40. By such a rotary actuating means the motive force of the pneumatic or hydraulic fluid is transmitted directly to the rotatable assembly 40 without the excessive clearance or backlash of an intermediate mechanism. Although the motive force for the rotatable assembly 40 is preferably provided by means of a pneumatic or hydraulic actuating fluid as illustrated in the drawings, it should be understood that electromagnetic or other means may be alternately employed to provide the motivating force for causing rotation of the rotatable assembly.

The rotatable sleeve member 42 includes linear bearing assemblies 72 and 74 at opposite ends of the coaxial opening 44 and which support the linearly movable elongated member 16 as described below. The linear bearing assembly 72 includes a generally cylindrical member 76 which snugly engages the inside of the coaxial opening 44, with a radially-extending flange 80 thereon. The flange 80 is secured to the rotatable sleeve member 42 for rotation therewith by a number of pins or fasteners 84 extending through a corresponding number of openings 85 in the flange 80. Similarly, the linear bearing assembly 74 includes a generally cylindrical member 78 snugly received in the opening 44 and secured for rotation with the rotatable sleeve member 42 by means of a number of fasteners 86 extending through a corresponding number of openings 87 in the flange 82. The fasteners 86 also extend through and securely engage a pinion gear 90, the purpose of which is explained in detail below.

As is best seen in FIGS. 5 and 6, the elongated shaft member 16 extends coaxially through openings 92 and 94 in the cylindrical members 76 and 78, respectively. The elongated shaft member 16 is interlocked with the cylindrical members 76 and 78 preferably by way of a ball spline connection which rotationally restrains the elongated shaft member 16 relative to the cylindrical members and the rotatable sleeve member 42, but allows the elongated shaft member to move linearly along the axis of rotation of the rotatable assembly. The ball spline connection includes a number of spline members 98 protruding outwardly from the elongated shaft member 16 in a generally radial direction and which are received in a corresponding number of axially elongated ways 100 in the cylindrical members 76 and 78. The ball spline connection also includes a number of ball bearing members 102 positioned within each of the elongated ways 100 between the spline members 98 and the cylindrical members 76 and 78.

Because of such ball spline connection between the shaft member 16 and the linear bearing assemblies 72 and 74, rotary motion is smoothly transmitted to the shaft member 16 with less tendency for it to bind than with prior art actuating devices. Furthermore, because the linear bearing assemblies remain a fixed distance apart even during shaft movement the load on an arm assembly attached to the shaft is adequately supported no matter what the orientation of the shaft member, be it vertical, horizontal or inclined.

In order to take up excessive clearance or backlash between the spline members 98, the elongated ways 100, and the ball bearing members 102, the cylindrical members 76 and 78 may be rotated slightly relative to each other before the fasteners 84 and 86 are completely tightened down to secure the flanges 80 and 82 to the rotatable sleeve member 42. Such slight relative rotation is accommodated by means of a slight amount of clearance between the inside walls of openings 85 and 87 and their respective fasteners 84 and 86. By slightly rotating the linear bearing assembly 72 and 74 in opposite directions, for example, the spline members 98 may be moved toward or away from opposite side portions of the elongated ways 100 in the cylindrical members 76 and 77 in order to decrease or increase the clearance in the ball spline connection between the elongated shaft member 16 and the linear bearing assemblies. This capability of adjusting the linear bearing clearance allows for highly precise actuation and positioning of the elongated shaft member 16 and thus the associated movable arm assembly 14, as well as allowing for adjustment of increased clearance resulting from wear.

Referring back to FIGS. 2 and 3, the elongated shaft member 16 is preferably actuated for linear axial movement along the axis 41 by a pneumatic or hydraulic cylinder 108, of the type well-known to those skilled in the art. Although such pneumatic or hydraulic cylinder is preferred, one skilled in the art will readily recognize that an electromagnetic solenoid device or other known linear actuating means may also be employed to impart linear axial motion to the elongated shaft member 16. Pneumatic or hydraulic actuating fluid is admitted to the cylinder 108 by way of fluid conduits and connectors 110 and 112, respectively, and controlled by control means well-known in the art to move the shaft member 16 and thus the arm assembly 14 to any of a number of desired axial positions.

The pinion gear 90 is drivingly enmeshed with a rack gear assembly 114, as shown in FIGS. 2 through 4, such that rotation of the rotatable assembly 40 is transformed into linear movement of a rack gear 116, which in turn is operatively connected to a pair of adjustable stop assemblies 118 and 120 for selectively limiting the rotational range of the rotatable assembly 40 and thus the elongated shaft member 16. The stop assemblies 118 and 120 each include force damping means, such as that shown for purposes of illustration at 122 and 124, for purposes of decelerating and cushioning the movement of the rotatable member and the elongated shaft member at the preselected outer limits of their rotational movement. One skilled in the art will readily recognize that such force damping means may consist of springs or other resilient force-cushioning apparatus, hydraulic or pneumatic dampers or shock absorbers, or any of a number of other known force damping devices known in the art.

The foregoing discussion discloses and describes exemplary embodiments of the present invention. One skilled in the art will readily recognize from such discussion that various changes, modifications and variations may be made therein without departing from the spirit and scope of the invention as defined in the following claims.

What is claimed is:

1. In an actuating device of the type having a housing, a rotatable assembly disposed within said housing assembly for rotation about an axis, at least a portion of said rotatable assembly being radially spaced from an inside wall of said housing assembly, said rotatable assembly having at least one vane member protruding therefrom for rotational movement therewith, said movable vane member slidably and sealingly engaging said inside wall of said housing assembly, said housing assembly having at least one fixed vane member protruding therefrom in slidable and sealing engagement with said rotatable assembly, said fixed and movable vane members separating said space between said rotatable assembly and said inside wall into at least a pair of fluid pressure chambers, fluid pressurizing means for varying the relative fluid pressures in said chambers in order to selectively vary the rotary position of said rotatable assembly within said housing assembly, said rotatable assembly further including an elongated member extending generally coaxially through said rotatable assembly for rotational movement therewith, wherein said rotatable assembly includes a rotatable sleeve member having an opening extending substantially coaxially therethrough, linear bearing means coaxially received within said opening in said rotatable sleeve member for rotation therewith, said elongated member extending substantially coaxially through said linear bearing means, and ball spline means rotationally interconnecting said elongated member and said linear bearing means to allow linear axial movement of said elongated member relative to said housing assembly, the improvement comprising adjustment means for rotating said cylindrical members relative to each other and for fixedly securing said cylindrical members in their relatively rotated positions in order to adjust the amount of backlash in said ball spline means.

2. An actuating device according to claim 1, wherein said linear bearing assembly includes at least a pair of generally cylindrical members received within said opening through said sleeve member at opposite ends thereof, said ball spline means including a number of spline members protruding outwardly from said elongated member in a generally radial direction, said spline members being received within a corresponding number of axially elongated ways in each said cylindrical members, and ball bearing members positioned within each of said elongated ways between said spline members and said cylindrical member.

3. An actuating device according to claim 2, wherein each of said cylindrical members includes a radially-extending flange generally at one end thereof, said adjustment means including a number of fasteners extending through a corresponding number of fastener openings in said flanges on said cylindrical members and threadably engaging said sleeve member at opposite ends thereof, the clearance between said fastener openings and said fasteners being sufficient to allow said relative rotation of said cylindrical members before said fasteners are tightened to secure said cylindrical members to said sleeve member.

4. An actuating device according to claim 3, further including a pinion gear rotationally fixed to said sleeve member and at least one of said cylindrical members for rotation therewith, said pinion gear drivingly engaging a rack gear in order to impart linear movement thereto as said rotatable assembly is rotated, and stop means operatively connected to said rack gear for limiting said rotatable assembly to a predetermined rotational range.

5. An actuating device according to claim 2, wherein said generally cylindrical members are axially fixed relative to said sleeve member and are spaced a fixed axial distance from each other, said cylindrical members being snugly received within said opening in said sleeve member in order to provide lateral support for said elongated member.

6. In a mechanism of the type having a movable member adapted for rotary movement about an axis and linear movement along said axis in order to move said movable member to various desired positions, a rotary and linear actuating device for imparting said rotary and linear movement to said movable member comprising a generally hollow cylindrical housing, a rotatable sleeve member coaxially disposed within said cylindrical housing and sealingly journaled for rotation therein about said axis, at least a portion of said sleeve member being radially spaced from the inside wall of said cylindrical housing to form a substantially fluid-tight annular chamber therebetween, said rotatable sleeve member having an axially-extending opening therethrough, at least one first vane member fixedly secured to said rotatable sleeve member and extending in a generally outward radial direction therefrom to slidably and sealingly engage said cylindrical housing, at least one second vane member fixedly secured to said cylindrical housing and extending in a generally inward radial direction therefrom to slidably and sealingly engage said rotatable sleeve member, said first and second vane members separating said annular chamber into at least a pair of fluid pressure chambers, fluid pressurizing means for admitting a fluid into each of said fluid pressure chambers and for selectively varying the relative fluid pressures therein in order to selectively rotate said rotatable sleeve member to various desired rotary positions, a linear bearing member received within said opening in said rotatable sleeve member generally at each opposite end thereof, each of said linear bearing members having an axially-extending bearing opening therethrough, said linear bearing members being substantially axially, laterally and rotationally fixed relative to said rotatable sleeve member, an axially-extending elongated member extending through said bearing openings, said elongated member being substantially restrained from rotation relative to said linear bearing members but linearly movable relative thereto and thereby being rotatable with said rotatable sleeve member about said axis and linearly movable along said axis, said elongated member further being adapted to be fixedly connected to said movable member for imparting said rotary and linear movement thereto, linear actuating means for selectively imparting said linear movement to said elongated member in order to selectively alter the axial position thereof, ball spline means for interconnecting said elongated member and said linear bearing members, said ball spline means including a number of spline members protruding radially outwardly from said elongated member, a corresponding number of axially elongated ways in said linear bearing members for receiving said spline members therein, and a plurality of ball bearing members disposed in said elongated ways between said spline members and the walls of said ways, the improvement comprising a pinion gear substantially secured to said rotatable sleeve member and at least one of said linear bearing members, a rack gear enmeshingly engaging said pinion gear, and adjustable stop means operatively connected to said rack gear for restricting said rotatable member and thus said elongated member to a predetermined adjustable range of rotary movement.

7. An actuating device according to claim 6, wherein said stop means also includes force damping means for decelerating said rotatable member and thus said elongated member at the outer limits of said range of rotary movement.

8. In a mechanism of the type having a movable member adapted for rotary movement about an axis and linear movement along said axis in order to move said movable member to various desired positions, a rotary and linear actuating device for imparting said rotary and linear movement to said movable member comprising a generally hollow cylindrical housing, a rotatable sleeve member coaxially disposed within said cylindrical housing and sealingly journaled for rotation therein about said axis, at least a portion of said sleeve member being radially spaced from the inside wall of said cylindrical housing to form a substantially fluid-tight annular chamber therebetween, said rotatable sleeve member having an axially-extending opening therethrough, at least one first vane member fixedly secured to said rotatable sleeve member and extending in a generally outward radial direction therefrom to slidably and sealingly engage said cylindrical housing, at least one second vane member fixedly secured to said cylindrical housing and extending in a generally inward radial direction therefrom to slidably and sealingly engage said rotatable sleeve member, said first and second vane members separating said annular chamber into at least a pair of fluid pressure chambers, fluid pressurizing means for admitting a fluid into each of said fluid pressure chambers and for selectively varying the relative fluid pressures therein in order to selectively rotate said rotatable sleeve member to various desired rotary positions, a linear bearing member received within said opening in said rotatable sleeve member generally at each opposite end thereof, each of said linear bearing members having an axially-extending bearing opening therethrough, said linear bearing members being substantially axially, laterally and rotationally fixed relative to said rotatable sleeve member, an axially-extending elongated member extending through said bearing openings, said elongated member being substantially restrained from rotation relative to said linear bearing members but linearly movable relative thereto and thereby being rotatable with said rotatable sleeve member about said axis and linearly movable along said axis, said elongated member further being adapted to be fixedly connected to said movable member for imparting said rotary and linear movement thereto, linear actuating means for selectively imparting said linear movement to said elongated member in order to selectively alter the axial position thereof, ball spline means for interconnecting said elongated member and said linear bearing members, said ball spline means including a number of spline members protruding radially outwardly from said elongated member, a corresponding number of axially elongated ways in said linear bearing members for receiving said spline members therein, and a plurality of ball bearing members disposed in said elongated ways between said spline members and the walls of said ways, a pinion gear substantially secured to said rotatable sleeve member and at least one of said linear bearing members, a rack gear enmeshingly engaging said pinion gear, and adjustable stop means operatively connected to said rack gear for restricting said rotatable member and thus said elongated member to a predetermined adjustable range of rotary movement, the improvement wherein each of said linear bearing members includes a radially-extending flange generally at one end thereof, each of said flanges having a number of axially-extending fastener openings therethrough, a corresponding number of fasteners being received in said fastener openings for threadably engaging said sleeve member in order to rotationally secure said linear bearing members to said sleeve member, the clearance between said fasteners and said fastener openings being sufficient to allow slight rotation of said linear bearing members relative to each other in order to selectively adjust the clearance between said spline members, said ball bearing members and said elongated ways before said fasteners are tightened to secure said linear bearing members to said sleeve member.

* * * * *